US007257875B2

(12) United States Patent
Masinelli et al.

(10) Patent No.: US 7,257,875 B2
(45) Date of Patent: Aug. 21, 2007

(54) METHOD FOR MAKING A PROTECTIVE DEVICE FOR GUARDRAILS, AND A PROTECTIVE DEVICE FOR GUARDRAILS

(76) Inventors: Giovanni Masinelli, Via Berlinguer, 23, 47813 Igea Marina (Rimini) (IT); Roberto Piastra, Via Franzolini, 101, 47825 Torriana (Rimini) (IT)

( * ) Notice: Subject to any disclaimer, the term of this patent is extended or adjusted under 35 U.S.C. 154(b) by 0 days.

(21) Appl. No.: 11/253,450

(22) Filed: Oct. 19, 2005

(65) Prior Publication Data

US 2006/0083588 A1 Apr. 20, 2006

(30) Foreign Application Priority Data

Oct. 20, 2004 (IT) ..... RN2004A0050

(51) Int. Cl.

| | |
|---|---|
| ***B23P 11/02*** | (2006.01) |
| ***B21K 21/16*** | (2006.01) |
| *A01K 3/00* | (2006.01) |
| *E01F 15/00* | (2006.01) |

(52) U.S. Cl. ..... 29/449; 256/13.1; 256/29; 404/6; 29/401.1

(58) Field of Classification Search ..... 29/448, 29/449; 404/6, 9; 256/1, 5, 13.1, 28–31
See application file for complete search history.

(56) References Cited

U.S. PATENT DOCUMENTS

| | | | | |
|---|---|---|---|---|
| 1,549,139 | A * | 8/1925 | Maudlin | 256/13.1 |
| 3,880,404 | A * | 4/1975 | Fitch | 256/1 |
| 4,063,713 | A * | 12/1977 | Anolick et al. | 256/13.1 |
| 4,212,496 | A | 7/1980 | Kirkham, Jr. | |
| 4,222,552 | A * | 9/1980 | Matteo, Sr. | 256/13.1 |
| 4,896,864 | A * | 1/1990 | Nusbaum | 256/23 |
| 5,429,449 | A * | 7/1995 | Baatz | 404/6 |
| 5,607,252 | A * | 3/1997 | Tischer | 404/6 |
| 6,113,076 | A * | 9/2000 | Hancock-Bogese et al. | 256/1 |
| 6,276,667 | B1 * | 8/2001 | Arthur | 256/13.1 |
| 6,719,276 | B1 * | 4/2004 | Bush | 256/1 |
| 2004/0067105 | A1 * | 4/2004 | Goesel | 404/9 |
| 2005/0263093 | A1 * | 12/2005 | Rosen | 119/524 |

FOREIGN PATENT DOCUMENTS

| | | |
|---|---|---|
| DE | 94 18 180 U1 | 1/1995 |
| ES | 2 191 517 A1 | 9/2003 |
| FR | 2 714 405 A1 | 6/1995 |
| FR | 2 752 255 A1 | 2/1998 |

* cited by examiner

*Primary Examiner*—David P. Bryant
*Assistant Examiner*—Christopher M Koehler
(74) *Attorney, Agent, or Firm*—Pearne & Gordon LLP

(57) ABSTRACT

A method for making a protective device for guardrails comprises the steps of preparing a sheet (2) of flexible material; wrapping the sheet (2) of flexible material between at least one portion (3) of a longitudinal rail (6) of a guardrail (5) and at least one portion (4) of a lower longitudinal element (7), positioned between at least two guardrail (5) uprights (8) at a predetermined height, other than zero, from the ground, to form a smooth and continuous surface (11) which at least partly covers the guardrail (5). A protective device for guardrails comprises at least one flexible sheet (2) which can be wrapped between at least one portion (3) of a rail (6) of a guardrail (5) and at least one portion (4) of a lower longitudinal element (7), positioned between at least two guardrail (5) uprights (8), to form a smooth and continuous surface (11) covering the guardrail (5).

11 Claims, 7 Drawing Sheets

METHOD FOR MAKING A PROTECTIVE DEVICE FOR GUARDRAILS, AND A PROTECTIVE DEVICE FOR GUARDRAILS

BACKGROUND OF THE INVENTION

The present invention relates to a method for making a protective device for guardrails and to a protective device for guardrails.

A guardrail is a highway safety barrier consisting of uprights, fixing means and longitudinal rails. The latter consist of one or more shaped plates with predetermined height which form a guardrail bumper or buffer zone. The plates are rigidly bound, by the fixing means, at predetermined heights from the ground, to uprights, that is to say, vertical supports, positioned at regular distances from each other designed to support the plates and hold them in position. Moreover, in some guardrails there is a lower longitudinal element, parallel with the plates, positioned at a predetermined height from the ground and bound to the uprights under the plates. The lower longitudinal element is also known as an anti-intrusion element.

Guardrails are positioned along the edges of roadways to contain and correct the trajectory of vehicles leaving the roadway in the event of an accident.

Although the longitudinal rails efficiently keep cars which skid in accidents on the roadway, they are not as effective if a motorcycle skids.

In most cases, a skid on a two-wheeled vehicle is immediately followed by the rider falling.

Since the longitudinal rails of the guardrails are positioned at heights corresponding to the height of the center of gravity of the most common types of cars, they are too high to stop a two-wheeled vehicle that is sliding on the ground.

For this reason, as indicated above, some guardrails are equipped with anti-intrusion elements located below the longitudinal rail.

However, although guardrails, particularly those with an anti-intrusion element, can stop or divert any vehicle that is out of control, they are extremely dangerous, if not fatal, for the riders of two-wheeled vehicles who lose control of the vehicle and consequently fall.

The shape and bending of the sheet metal used for the uprights and the rails, the fixing elements used (bolts, screws or other devices) and the reflectors usually fixed to the rails to make them more visible at night, all mean that guardrails present numerous sharp, cutting edges. Obviously, said edges are a serious threat to motorcyclists who fall from their two-wheeled vehicle. Quite frequently following such collisions against guardrails, motorcyclists or cyclists suffer permanent disability or serious injury caused by the presence of these sharp, cutting edges.

Moreover, guardrails made from sheet metal are now so widely used that their substitution with other barrier types (for example, those made from concrete) which do not present sharp, cutting and potentially hazardous edges is considered too complicated and expensive.

SUMMARY OF THE INVENTION

In this context, the main technical need which forms the basis of the present invention is to propose a method for making a protective device for guardrails, and a protective device for guardrails which overcome the above-mentioned disadvantages.

In particular, the aim of the present invention is to provide a method for making a protective device for guardrails, and a protective device for guardrails which allows the function and structure of existing guardrails to remain unchanged but which reduces the danger they present if a rider falls from his vehicle.

Another aim of the present invention is to propose a method for making a protective device for guardrails, and a protective device for guardrails which can easily and rapidly be applied to existing guardrails.

Yet another aim of the present invention is to provide a protective device for guardrails with very reasonable production costs.

The technical need indicated and the aims specified are substantially achieved by a method for making a protective device for guardrails, and a protective device for guardrails comprising the technical features described in one or more of the claims herein.

BRIEF DESCRIPTION OF THE DRAWINGS

Further features and advantages of the present invention are more apparent in the detailed description below, with reference to a preferred, non-limiting, embodiment of a method for making a protective device for guardrails, and a protective device for guardrails, illustrated in the accompanying drawings, in which.

DESCRIPTION OF THE PREFERRED EMBODIMENTS

Figure 1:
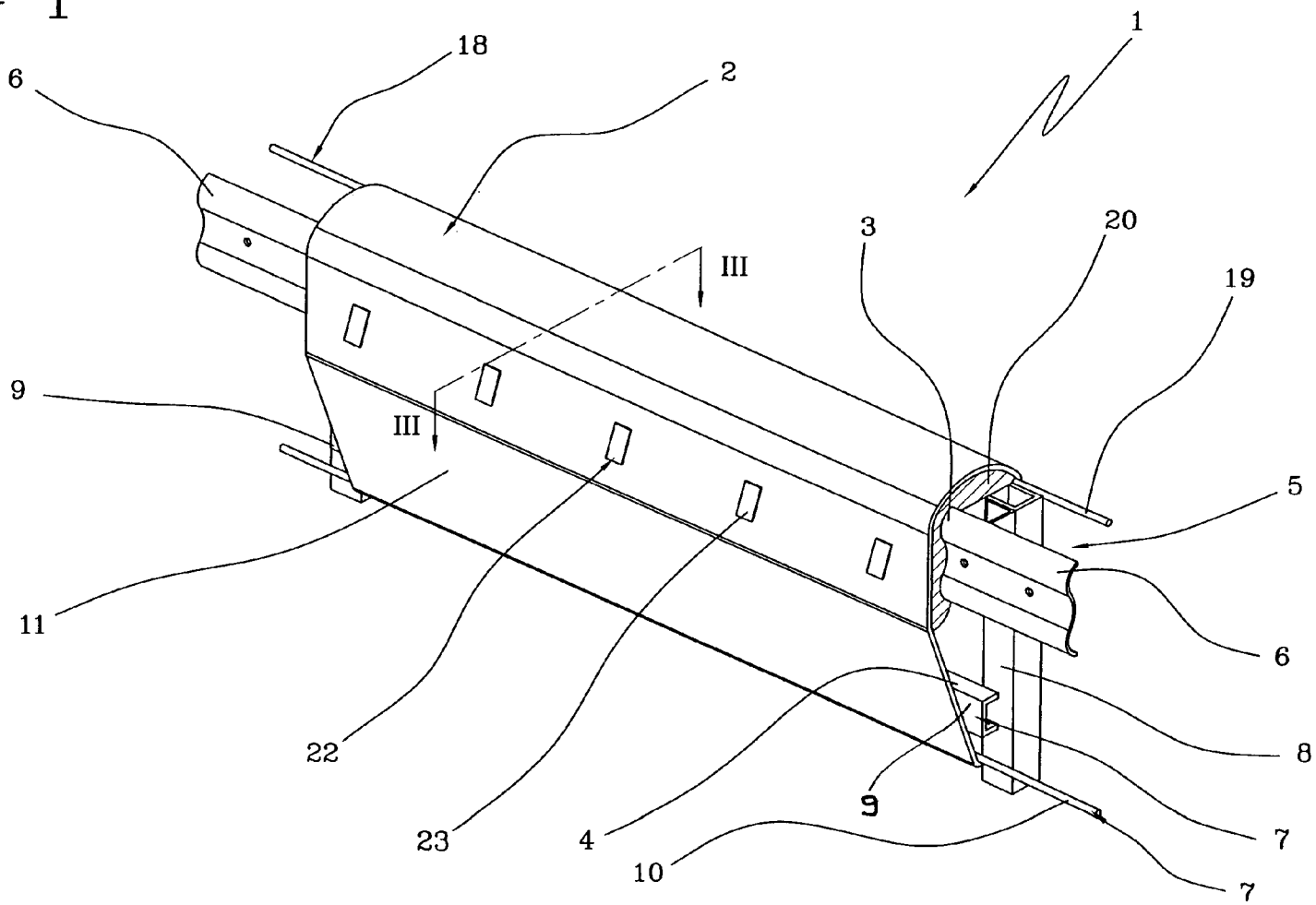
FIG. 1 is a perspective view of a protective device for guardrails in accordance with the present invention.
Figure 2:
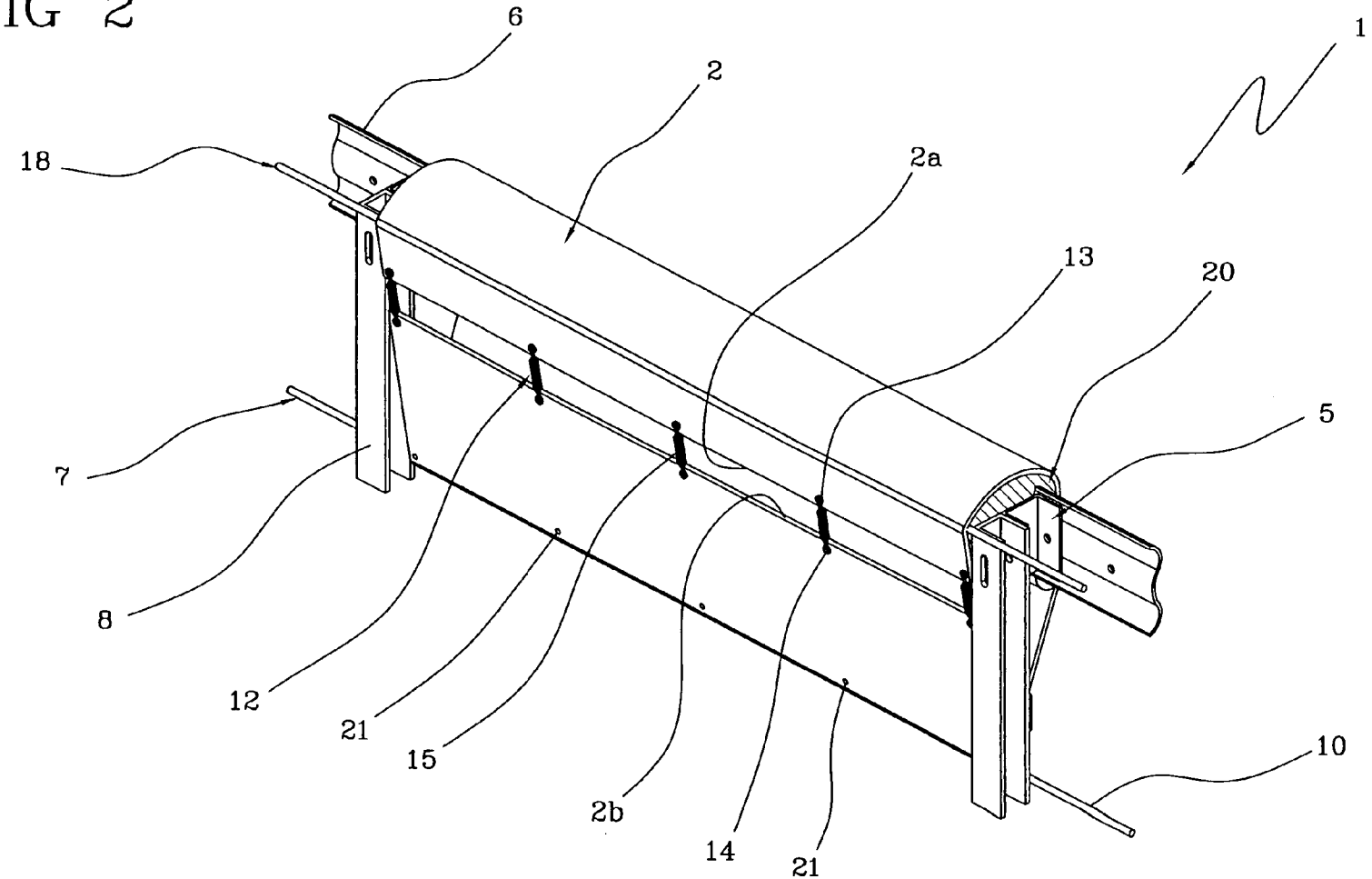
FIG. 2 is another perspective view of the device illustrated in FIG. 1, with some parts cut away to better illustrate others.
Figure 3:
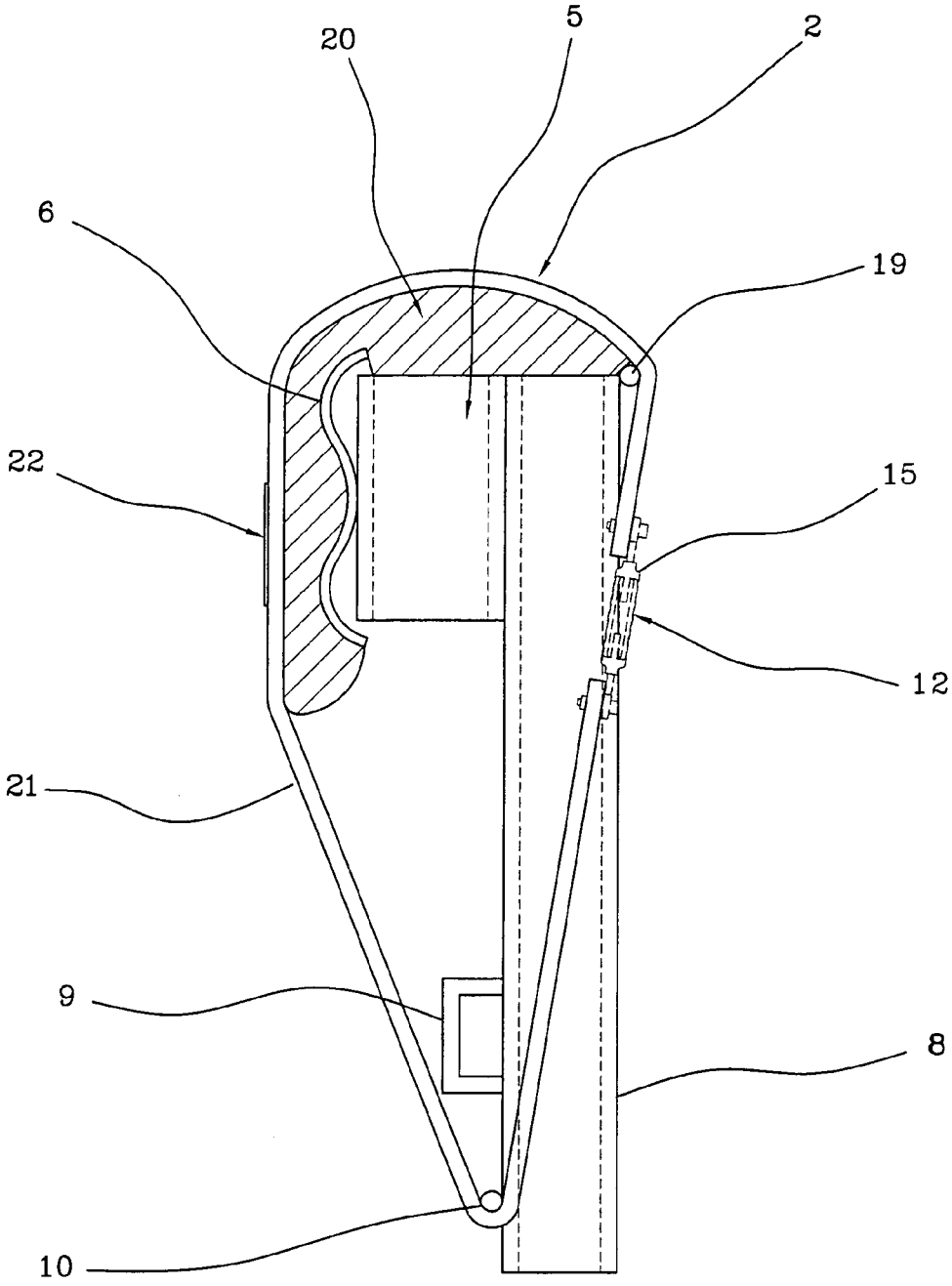
FIG. 3 is a cross-section of the device according to the line III-III illustrated in FIG. 1.

With reference to FIGS. 1, 2 and 3, the numeral 1 denotes a protective device for guardrails according to the present invention.

The protective device 1 comprises at least one flexible sheet 2 which can be wrapped between two zones 3, 4 of a guardrail 5.

In particular, the first zone 3 of a guardrail 5 around which the flexible sheet 2 is wrapped is at least one portion of a guardrail 5 longitudinal rail 6.

The second zone 4 around which the flexible sheet 2 is wrapped is at least one portion of a lower longitudinal element 7 located between at least two guardrail 5 uprights 8. It should be noticed that the term longitudinal rail 6 of a guardrail refers to the bumper or buffer zone of the guardrail, positioned at a predetermined height from the ground, normally coinciding with the height of the center of gravity of the most common models of cars and supported by the uprights 8.

The term lower longitudinal element 7 refers to an element which extends substantially parallel with the guardrail 5 rail 6, extending at a height from the ground lower than that of the longitudinal rail 6 and which is integral with at least two guardrail 5 uprights 8.

Said lower longitudinal element 7 is normally part of the guardrail 5 structure and is called an anti-intrusion element 9. In this case, the flexible sheet 2 may be wrapped around said anti-intrusion element 9.

Advantageously, if the anti-intrusion element 9 is not present or is positioned at an unsuitable height (in the sense specified below), the device 1 comprises at least one first rod-shaped element 10 which can be stably bound to at least two uprights 8 on the guardrail at a predetermined height, other than zero, from the ground.

In particular, the rod-shaped element 10 is bound to the uprights 8 at a height from the ground of between 2 cm and 20 cm, preferably 5 cm.

The fact that the height of the rod-shaped element 10 from the ground is not zero, and, consequently, that the sheet of flexible material does not reach the ground, allows rainwater to run under the device 1 and avoid flooding the roadway.

In any event, the height of the rod-shaped element 10 must be such that it prevents a person of medium build from slipping between the rod-shaped element 10 and the ground after falling from his vehicle.

In this way, advantageously, the flexible sheet 2 wrapped between the longitudinal rail 6 and the lower longitudinal element 7 forms a smooth and continuous surface 11 at least partly covering the guardrail 5.

The device 1 comprises adjustable tensioning means 12 operating on the flexible sheet 2 to adjust the tension of the flexible sheet 2 wrapped on the guardrail 5.

In particular, the flexible sheet 2 comprises a first edge 2*a* and a second edge 2*b*. After the sheet 2 has been wrapped in position, the first and second edges 2*a*, 2*b* of the sheet are opposite and distanced from one another.

The tensioning means 12 operate between the first and second edges 2*a*, 2*b* of the sheet 2, adjusting the distance between the two. In this way, the tension of the sheet 2 wrapped in position can be adjusted, making the covering surface 11 for the guardrail 5 more or less stiff.

Moreover, as illustrated in FIGS. 2 and 3, the tensioning means 12 extend on the opposite side to the roadway, that is to say, on the opposite side to the longitudinal rail 6 and the surface 11 of the sheet 2.

In detail (illustrated in particular in FIGS. 2, 3 and 4), the tensioning means 12 comprise at least one first slot 13 made on the first edge 2*a* of the flexible sheet 2 and at least one second slot 14 on the second edge 2*b* of the flexible sheet 2. Preferably, all of the slots 13, 14 are edged by strengthening rings (of the known type and therefore not illustrated) to prevent laceration of the flexible sheet 2.

Between the first and second edges 2*a*, 2*b* of the flexible sheet 2 the tensioning means 12 comprise at least one tension rod 15 engaged with a first end in the first slot 13, and with a second end in the second slot 14.

Figure 4:
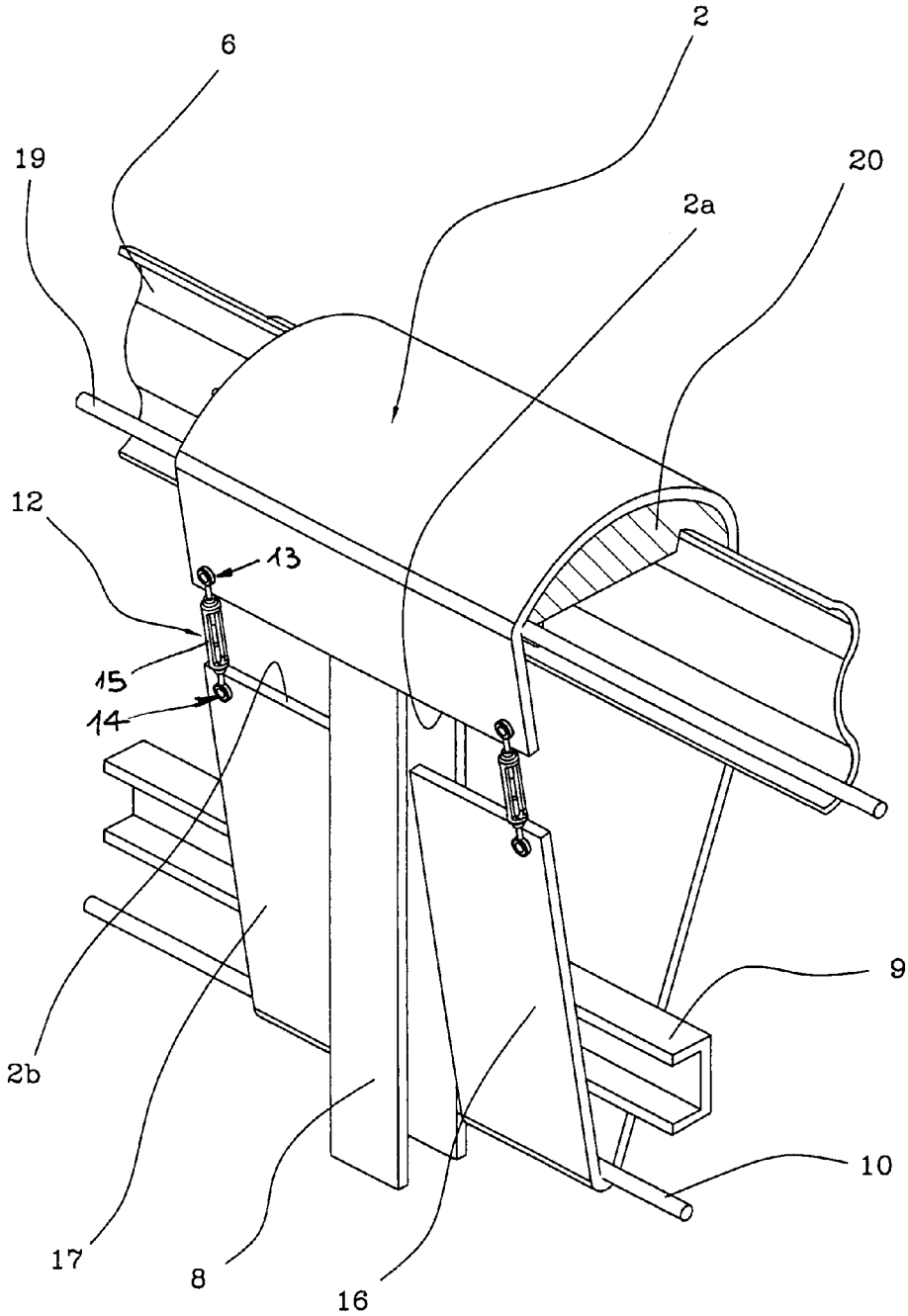
FIG. 4 is a view of the device illustrated in FIG. 1 according to the same perspective as FIG. 2 and reproducing the parts cut away in FIG. 2.

In FIGS. 2 and 4 the slots 13, 14, although having their position indicated, are hidden by the means for hooking the tension rod 15 to the flexible sheet 2.

Advantageously, as illustrated in FIG. 4, the flexible sheet 2 is also suitable for being wrapped between the longitudinal rail 6 and the lower longitudinal element 7 in a region of guardrail where an upright 8 is located.

In this case, since the upright 8 extends down to the ground, the flexible sheet 2 comprises two projections 16, 17 which extend from the second edge 2*b*. The latter, in combination with the two projections 16, 17 forms a groove designed to make contact with the guardrail 5 upright 8. The projections 16, 17 extend beyond the upright 8 towards the first edge 2*a* of the flexible sheet 2.

Advantageously, each of the two projections comprises a slot in which the tension rod 15 can engage to bind to the first edge 2*a* and allow the flexible sheet 2 to be tensioned.

Advantageously, to prevent the flexible sheet 2 from being damaged by contact with the upper end part of the uprights 8, the device 1 comprises at least one non-cutting profile 18. The latter comprises at least one second rod-shaped element 19 which can be stably bound to at least two uprights 8 in a zone of each upright 8 having a maximum height from the ground. In other words, as illustrated in FIGS. 1, 2, 3 and 4, the second rod-shaped element 19 is positioned on the upper end part of the uprights 8, allowing the flexible sheet 2 to be wrapped around the guardrail 5 without any direct contact with any sharp edges present in the upper part of the guardrail 5.

Moreover, the device 1 comprises cushioning means 20 which can be inserted at least between the longitudinal rail 6 and the flexible sheet 2.

In particular, the cushioning means 20 may be made of one or more polyurethane foam elements and are designed to dissipate the kinetic energy of a body which strikes the guardrail 5 on which the device 1 is mounted.

Obviously, the cushioning means 20 can preferably be inserted between the flexible sheet 2 and the guardrail 5 in zones in which impact is most likely, that is to say, for example, in zones of the guardrail directly opposite a roadway.

If placed in a suitable position (for example, that illustrated in FIGS. 1 to 4), the cushioning means can also aid the action of the non-cutting profiles 18 or, in certain cases, even substitute them completely.

Since, as indicated, the first and second edges 2*a*, 2*b* of the flexible sheet 2 are, after the sheet is wrapped around the guardrail 5, opposite and distanced from one another, the flexible sheet 2 comprises at least one opening 21 at the lower longitudinal element 7. Said opening 21, in the preferred embodiment there being a plurality of openings 21, is designed to allow the outflow of any water which, following a stormy downpour, gets between the two edges 2*a*, 2*b* of the flexible sheet 2 and is deposited in the lower part of the device 1, that is to say at the lower longitudinal element 7.

Advantageously, to increase device 1 visibility or to restore the visibility of the guardrail 5 wrapped in the flexible sheet 2, the flexible sheet 2 comprises visual signaling means 22. In the preferred embodiment the visual signaling means 22 comprise reflectors 23 applied to the flexible sheet 2 or incorporated in the flexible sheet 2.

Moreover, the visual signaling means 22 may comprise, together with or as an alternative to the reflectors 23, reflective or fluorescent material pigments (of the known type and therefore not illustrated). Said pigments are integrated in the structure of the flexible sheet 2.

Figure 5:
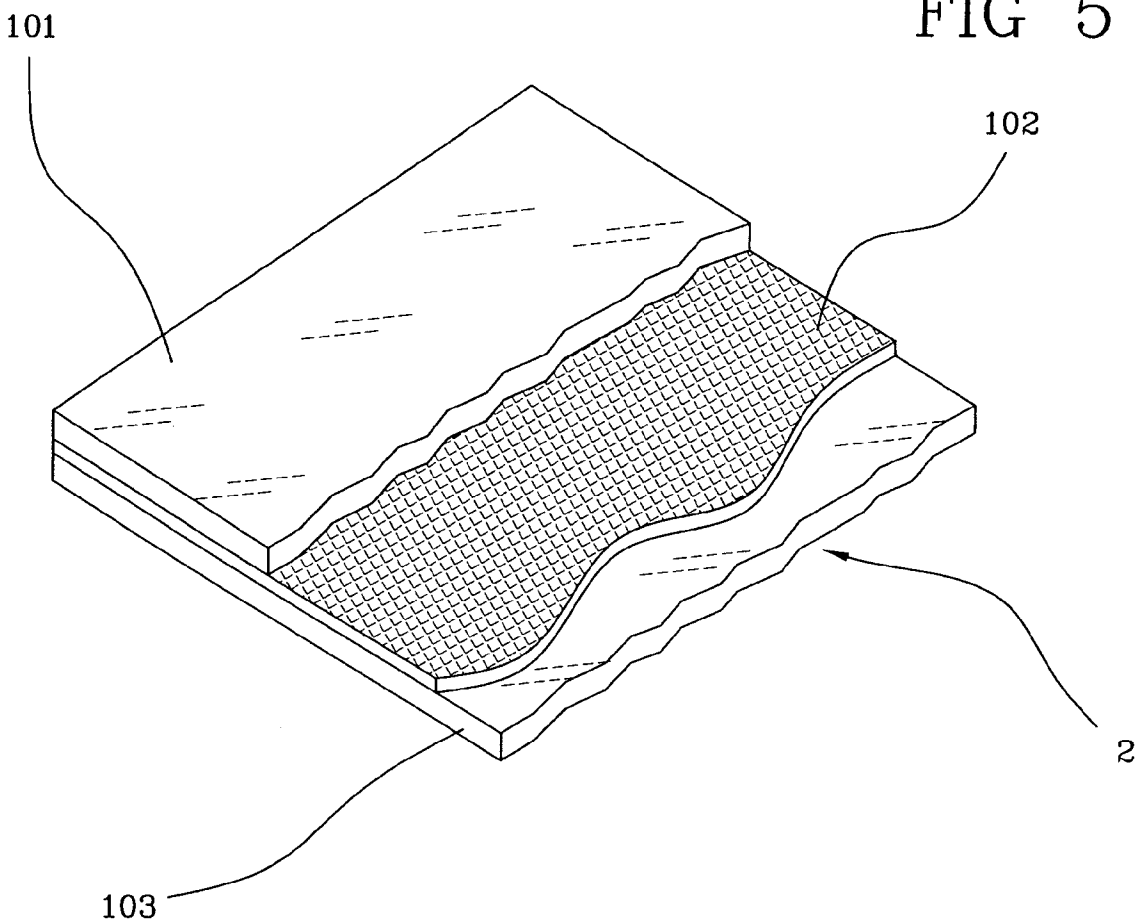
FIG. 5 is a perspective view of a detail of the device illustrated in FIG. 1, with some parts cut away to better illustrate others.
Figure 6:
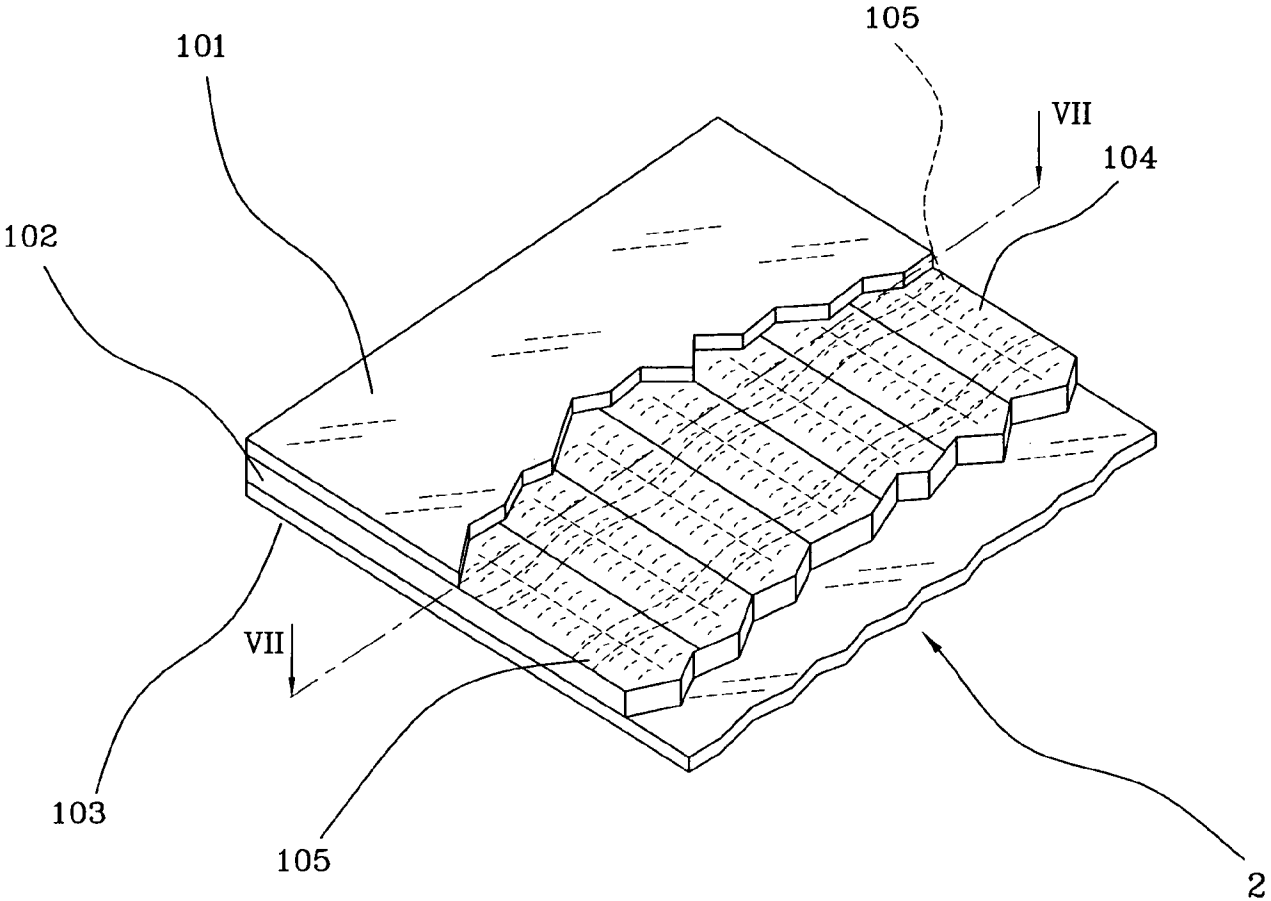
FIG. 6 is a perspective view of an alternative embodiment of the detail illustrated in FIG. 5.

From a structural viewpoint, as illustrated in FIGS. 5 and 6, the flexible sheet 2 comprises a first layer 101, a second layer 102 and a third layer 103.

In the preferred embodiment illustrated in FIG. 5, the first layer of the flexible sheet 2 consists of flexible material, in particular, very advantageously, deriving from recycled tires.

In particular, the first layer 101 is obtained from the bodies of worn tires from which the metal components are removed. All of the remaining material which forms the tire is finely ground to obtain a uniform mass of rubbery material.

Following extrusion or compacting in suitable dies, the rubbery material is compacted in a layer which forms the first layer 101 of the flexible sheet 2. As indicated, said layer may have reflectors and/or reflective and/or fluorescent material pigments embedded in it.

The third layer 103 of the flexible sheet 2 is also obtained from flexible material, in particular, very advantageously, deriving from used tires, in a way completely similar to the first layer 101.

Advantageously, the second layer 102 of the flexible sheet 2 is made of a nylon mesh. The flexible sheet 2 is completed by joining the first layer 101 to the second layer 102 and the second layer 102 to the third layer 103.

This gives a sheet 2 with optimum flexibility which allows the sheet 2 to easily be wrapped on the guardrail.

Moreover, the second, nylon layer 102 gives the flexible sheet 2 optimum mechanical strength, making it very resistant to the penetrating action of objects striking it and stiff enough to resist impact without excessive deformation.

In other words, the nylon layer 102 increases the mechanical strength of the two layers 101, 103 of rubbery material.

In an alternative embodiment, illustrated in FIG. 6, the first layer 101 and the third layer 103 consist of rubber, whilst the second layer 102 is made as a composite layer. In particular, the second layer 102 comprises first strips 104 of elastic material, parallel with and substantially adjacent to one another, with predetermined thickness and width. The first strips 104 are preferably made of a material obtained from used tires. In particular, advantageously, as illustrated in particular in FIG. 6, the first strips 104 consist of the portion of tread of used tires removed from the tires and laid flat. Advantageously, the portion of tread comprises at least part of the reinforcing fabric, thus giving the flexible sheet 2 a particular mechanical strength. Preferably, the portions of tread used to make the first strips 104 are removed from radial tires. The first strips 104 obtained in this way have a very limited curvature across their longitudinal extension so that once they are laid flat, practically their entire width can be used without creating any major flatness problems to the second layer 102 and, as a result, to the sheet 2.

Figure 7:
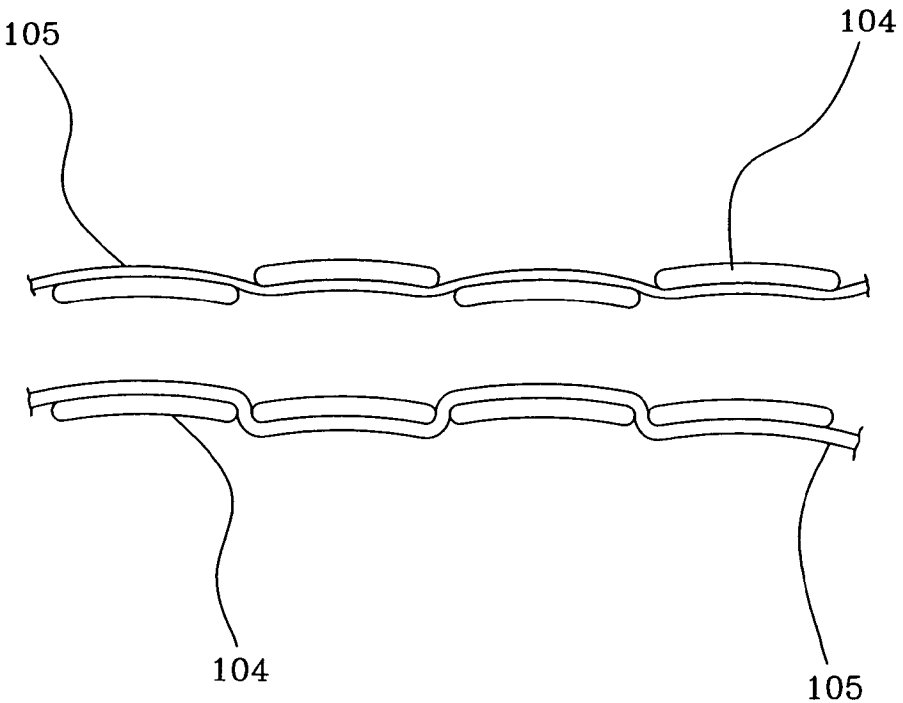
FIG. 7 is a cross-section of the detail according to line VI-VI illustrated in FIG. 6, with some parts cut away to better illustrate others.

The second layer 102 also preferably comprises second strips 105 of elastic material, arranged transversally to the first strips 104 and joined to the latter. The first and second strips 104, 105 are woven together like the weft of a fabric. In particular, the second strips 105 can be positioned substantially parallel with one another at a predetermined distance from each other, each second strip 105 passing alternatively over and under and then again over the layer of first strips 104 at consecutive first strips 104, as illustrated in FIG. 7. FIG. 7 shows two possible wefts of this type: one slightly less stiff at the top of the Figure and one stiffer at the bottom of the Figure. Obviously, the first and second strips 104, 105 will preferably be joined together in such a way as to guarantee maximum flatness for the flexible sheet 2.

Irrespective of the first or the second embodiment, the various layers of the flexible sheet 2 may be joined together in a number of ways, for example by gluing, sealing, stapling or the like. However, gluing and sealing are preferable, like all joining methods which do not involve the introduction, on the outer surface 11 of the first layer 101, of irregularities, bulges or anything that may be dangerous in an impact with the human body.

In any case, the first layer 101 is mainly intended to make the outer surface 11 of the covering device 1 continuous and free of edges.

Advantageously, the flexible sheet 2 (in particular, where present, the first layer 101 and/or the second layer 102) may be painted or colored (either with surface painting or integration of pigments in the structure of the flexible sheet 2) or screen printed to make the outside attractive for urban furnishing purposes or so as not to spoil the landscape.

As well as the device 1, the present invention relates to a method for making a protective device for guardrails.

In particular, said method comprises the steps of preparing a sheet 2 of flexible material; wrapping the sheet 2 of flexible material between at least one portion 3 of a longitudinal rail 6 of a guardrail 5, which forms a bumper zone, and at least one portion 4 of a lower longitudinal element 7, between at least two guardrail 5 uprights 8 at a predetermined height, other than zero, from the ground, to form a smooth and continuous surface 11 which at least partly covers the guardrail 5.

Said lower longitudinal element 7 is normally part of the guardrail 5 structure and is called an anti-intrusion element 9. In this case, the flexible sheet 2 may be wrapped around said anti-intrusion element 9.

Advantageously, if the anti-intrusion element 9 is not present or is positioned at an unsuitable height (in the sense already specified), the method comprises a preliminary step of stably binding at least one first rod-shaped element 10 to at least two uprights 8 on the guardrail at a predetermined height, other than zero, from the ground.

In particular, the rod-shaped element 10 is bound to the uprights 8 at a height from the ground of between 2 cm and 20 cm, preferably 5 cm.

The method also comprises the step of tensioning the flexible sheet 2 wrapped between the portion of longitudinal rail 6 and the lower longitudinal element 7 to give the desired stiffness to the continuous surface 11 covering the guardrail 5.

In detail the step of tensioning the flexible sheet 2 involves making at least one first slot 13 on a first edge 2*a* of the flexible sheet 2 and at least one second slot 14 on a second edge 2*b* of the flexible sheet 2. Preferably, all of the slots 13, 14 are edged by strengthening rings (of the known type and therefore not illustrated) to prevent laceration of the flexible sheet 2.

Moreover, the step of tensioning the flexible sheet 2 involves placing at least one tension rod 15 between the first and second edges 2*a*, 2*b* of the flexible sheet 2. In particular the tension rod 15 is rendered operational by engaging it between the slots 13, 14 of the respective first and second edges 2*a* 2*b*.

In FIGS. 2 and 4 the slots 13, 14, although having their position indicated, are hidden by the means for hooking the tension rod 15 to the flexible sheet 2.

Advantageously, the flexible sheet 2 is also wrapped between the longitudinal rail 6 and the lower longitudinal element 7 in a region of guardrail where an upright 8 is located.

In this case, since the upright 8 extends down to the ground, the step of preparing the flexible sheet 2 comprises the preliminary step of making two projections 16, 17 which extend from the second edge 2*b*. The latter, in combination with the two projections 16, 17 forms a groove designed to make contact with the guardrail 5 upright 8. The projections 16, 17 extend beyond the upright 8 towards the first edge 2*a* of the flexible sheet 2.

Advantageously, the latter step also involves making, in each of the two projections, a slot in which the tension rod 15 can engage to bind the two projections to the first edge 2*a* and allow the flexible sheet 2 to be tensioned.

Advantageously, to prevent the flexible sheet 2 from being damaged by contact with the upper end part of the uprights 8, the method comprises the step of preparing at least one non-cutting profile 18. The latter comprises at least one second rod-shaped element 19 stably bound to at least two uprights 8 in a zone of each upright 8 having a maximum height from the ground.

The method also comprises the step of inserting cushioning means 20 at least between the longitudinal rail 6 and the flexible sheet 2.

Obviously, the cushioning means 20 are preferably inserted between the flexible sheet 2 and the guardrail 5 in zones in which impact is most likely, that is to say, for example, in zones of the guardrail directly opposite a roadway.

Since, as indicated, the first and second edges 2*a*, 2*b* of the flexible sheet 2 are, after the sheet is wrapped around the guardrail 5, opposite and distanced from one another, at least one opening 21 is made in the flexible sheet 2 at the lower longitudinal element 7. Said opening 21, in the preferred embodiment there being a plurality of openings 21, is designed to allow the outflow of any water which, following a stormy downpour, gets between the two edges 2*a*, 2*b* of the flexible sheet 2 and is deposited in the lower part of the device 1, that is to say at the lower longitudinal element 7.

Advantageously, to increase device 1 visibility or to restore the visibility of the guardrail 5 wrapped in the flexible sheet 2, the method comprises the step of preparing visual signaling means 22. In the preferred embodiment the visual signaling means 22 consist of reflectors 23 applied to the flexible sheet 2 or incorporated in the flexible sheet 2.

Moreover, the visual signaling means 22 may consist, together with or as an alternative to the reflectors 23, of reflective or fluorescent material pigments. Said pigments are integrated in the structure of the flexible sheet 2.

Advantageously, the flexible sheet 2 may be painted or colored (either with surface painting or integration of pigments in the structure of the flexible sheet 2) or screen printed to make the outside attractive for urban furnishing purposes or so as not to spoil the landscape.

Similarly to what is described relative to the device 1, the method comprises the step of preparing the sheet 2 of flexible material with a first layer 101 obtained from recycled tires, a second layer 102 made of nylon, and a third layer 103 obtained from recycled tires.

The technical features of these layers is exactly the same as described relative to the device 1. Similarly, in an alternative embodiment, the method comprises the steps of preparing a first layer 101 of rubber, preparing a second layer 102 obtained from recycled tires, a third layer 103 of rubber, and stably joining the first layer 101 to the second layer 102 and the second layer 102 to the third layer 103.

Again, all of the technical features of the three layers are exactly the same as already described relative to the device 1.

The present invention achieves the preset aims.

Since the device 1 is wrapped on an existing guardrail, the function and structure of the guardrails remain unchanged.

Moreover, the danger in the event a rider falls from his vehicle is greatly reduced thanks to the continuous surface without cutting edges of the device 1 facing the roadway.

In addition, the protective device for guardrails disclosed and the method described can easily and rapidly be applied on existing guardrails, requiring minimal and marginal installation work on the guardrails.

Finally, the protective device for guardrails has extremely reasonable production costs, since most of its structure is obtained from recycled material.

The present invention brings an important advantage.

Since worn tires are produced in huge numbers due to the vast number of vehicles on the roads, disposing of them is quite a big and serious problem.

The device and method disclosed allow a large number of worn tires to be disposed of, partly solving the problem of recycling them.

What is claimed is:

1. A method for retrofitting a protective device on existing highway or roadway guardrails comprising the steps of:

preparing a sheet (2) of flexible material;

wrapping the sheet (2) of flexible material between at least one portion (3) of a longitudinal rail (6) of a highway or roadway guardrail (5), which forms a bumper zone, and at least one portion (4) of a lower longitudinal element (9) of the highway or roadway guardrail, positioned between at least two guardrail (5) uprights (8) of the highway or roadway guardrail (5) at a predetermined height, other than zero, from the ground, forming a smooth and continuous surface (11) which at least partly covers the guardrail (5), wherein:

the step of wrapping the sheet (2) of flexible material is preceded by the step of stably binding a first rod-shaped element (10) to at least two uprights (8) of the highway or roadway guardrail (5) at a height, other than zero, from the ground which prevents a person from slipping between the first rod-shaped element (10) and the ground after falling from a vehicle and which allows rainwater to run under the protective device avoiding the flooding of the highway or roadway;

the step of wrapping the sheet (2) of flexible material is preceded by the step of preparing at least one non-cutting profile (18) on the highway or roadway guardrail (5) around which the sheet (2) is wrapped, the step of preparing a non-cutting profile (18) comprising, in turn, the step of stably binding a second rod-shaped element (19) to at least two guardrail (5) uprights (8) in a zone of each upright having a maximum height from the ground, thus allowing the flexible sheet (2) to be wrapped around the highway or roadway guardrail (5) without any direct contact with any sharp edges present in the upper part of the highway or roadway guardrail (5);

the flexible sheet (2) being wrapped around the at least one portion of the longitudinal rail (6), at least one portion of the non-cutting profile (18) and at least one portion of the first rod-shaped element (10).

2. The method according to claim 1, comprising the step of tensioning the sheet (2) of flexible material wrapped between the portion of guardrail (5) longitudinal rail (6) and the lower longitudinal element (7) positioned between two guardrail (5) uprights (8).

3. The method according to claim 1, wherein the step of wrapping the sheet (2) of flexible material comprises the step of inserting a cushioning material at least between the sheet (2) of flexible material and the portion of rail (6) of guardrail (5).

4. The method according to claim 1, comprising the step of making at least one opening (21) in the sheet (2) of flexible material at the lower longitudinal element (7), forming a zone for the outflow of rainwater.

5. The method according to claim 1 wherein the step of preparing a sheet (2) of flexible material comprises the steps of preparing a first layer (101) made of flexible material, preparing a second layer (102) made of nylon, preparing a third layer (103) made of flexible material, stably joining the first layer (101) to the second layer (102) and the second layer (102) to the third layer (103).

6. The method according to claim 5, wherein the second layer (102) made of nylon has a mesh structure.

7. The method according to claim 5, wherein the first layer (101) and/or the third layer (103) is obtained from recycled tires.

8. The method according to claim 6, wherein the first layer (101) and/or the third layer (103) is obtained from recycled tires.

9. The method according to claim 1, wherein the step of preparing a sheet of flexible material comprises the step of preparing a first layer (101) made of rubber, preparing a second layer (102) obtained from recycled tires, and a third layer (103) made of rubber, stably joining the first layer (101) to the second layer (102) and the second layer (102) to the third layer (103).

10. The method according to claim 1, wherein the step of preparing a sheet (2) of flexible material comprises the step of making two projections (16, 17) on the sheet (2) for wrapping a portion of guardrail (5) where an upright (8) is located.

11. The method according to claim 1, comprising the step of equipping the flexible sheet (2) with visual signaling means (22).

* * * * *